US005117518A

United States Patent [19]

Schild

[11] Patent Number: 5,117,518

[45] Date of Patent: Jun. 2, 1992

[54] PRESSURE CONTROLLER

[75] Inventor: Rolf Schild, London, England

[73] Assignee: Huntleigh Technology, Plc, United Kingdom

[21] Appl. No.: 543,753

[22] PCT Filed: Mar. 8, 1989

[86] PCT No.: PCT/GB89/00232

§ 371 Date: Aug. 28, 1990

§ 102(e) Date: Aug. 28, 1990

[87] PCT Pub. No.: WO89/08438

PCT Pub. Date: Sep. 21, 1989

[30] Foreign Application Priority Data

Mar. 14, 1988 [GB] United Kingdom ..... 8805961

[51] Int. Cl.[5] ..... A47C 27/08

[52] U.S. Cl. ..... 5/453; 5/455; 5/914

[58] Field of Search ..... 5/453, 455, 456, 457

[56] References Cited

U.S. PATENT DOCUMENTS 3,297,023 1/1967 Foley .
3,727,606 4/1973 Sielaff .
3,909,858 10/1975 Ducker .
3,919,730 11/1975 Regan .
4,005,236 1/1977 Graebe .
4,175,297 11/1979 Robbins et al. .
4,197,837 4/1980 Tringall et al. ..... 5/453
4,320,766 3/1982 Alihanka et al. ..... 128/671
4,694,520 9/1987 Paul et al. ..... 5/453
4,825,486 5/1989 Kimura et al. ..... 5/453
4,873,737 10/1989 Savenije ..... 5/453

*Primary Examiner*—Renee S. Luebke
*Assistant Examiner*—Michael J. Milano
*Attorney, Agent, or Firm*—Fitzpatrick, Cella, Harper & Scinto

[57] ABSTRACT

A pressure controller for controlling fluid pressure in an alternating pressure pad which comprises a member sensitive to the fluid pressure and adapted to open a valve when the pressure exceeds a predetermined value, a sensor pad connected at one end of the valve and at the other end being adapted for connection to a pump for inflating the pad. The sensor pad is arranged, in use, to receive pressure exerted by a patient on the pad and to be compressible in dependence upon the pressure exerted by the patient to reduce the escape of fluid from the valve when the valve is open. Thereby, causing a proportion of fluid to continue to inflate the pad.

9 Claims, 3 Drawing Sheets

1
2
3
4
5
6
7
8
9
10
11
12
14
15
16
17
18
19a
19b
20
22
23

17
20
21

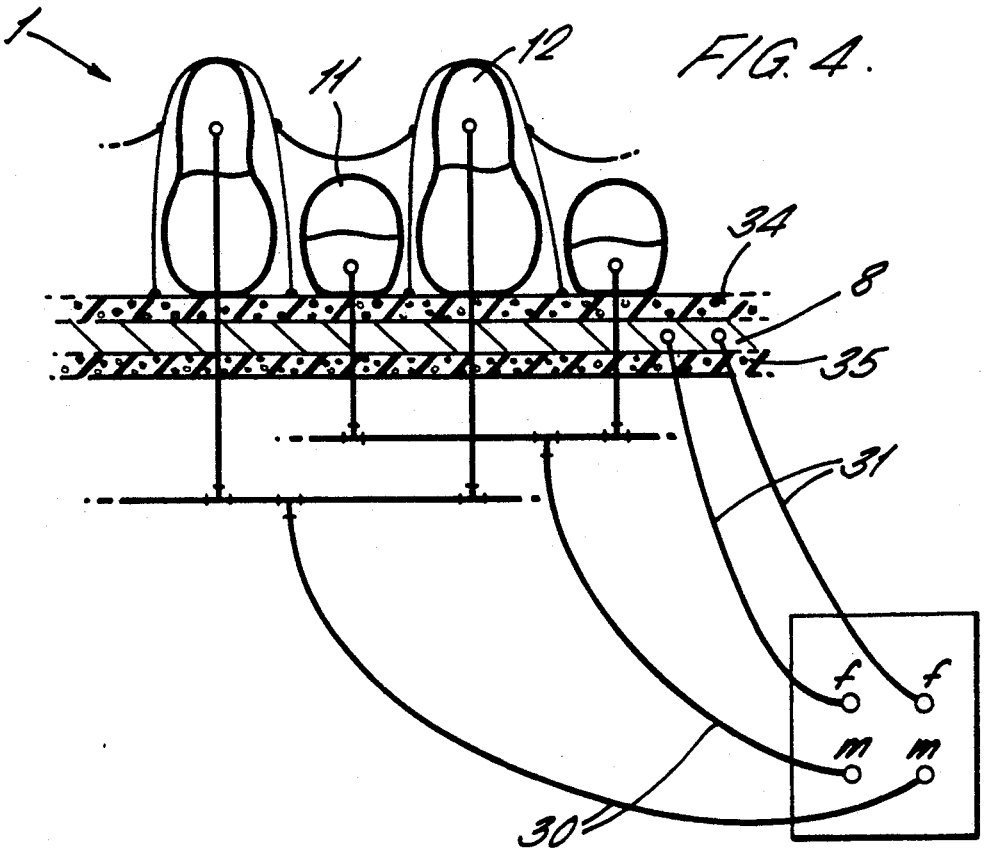
FIG. 4.
FIG. 5.
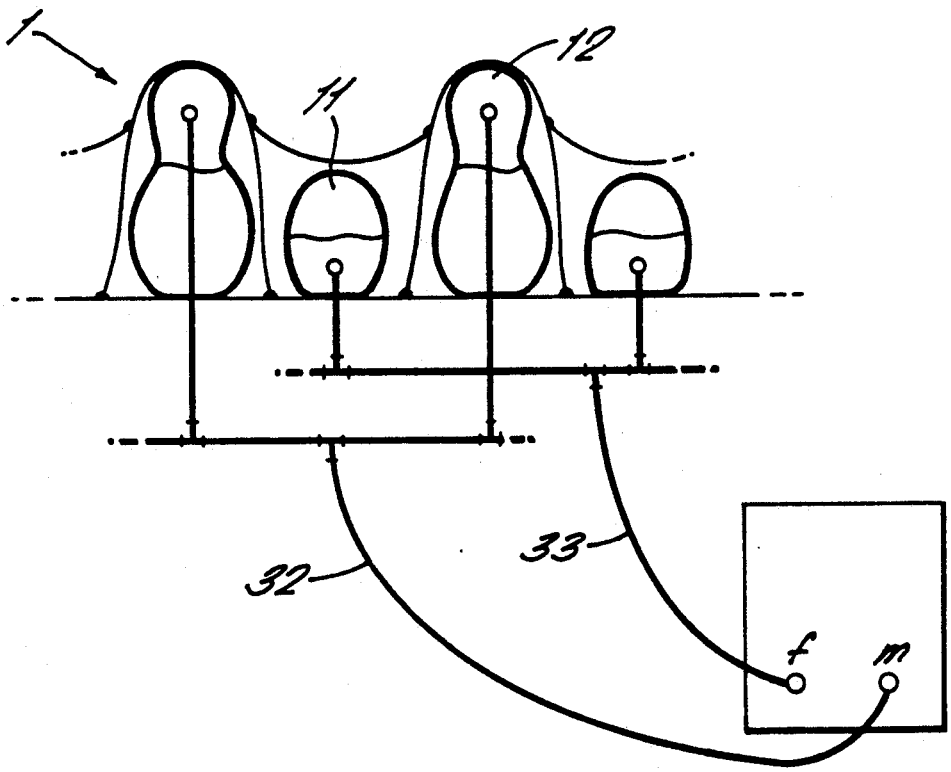

PRESSURE CONTROLLER

This invention relates to a pressure controller, and in particular to a pressure controller for controlling fluid pressure in an alternating pressure pad. Generally, the fluid in such a pad is air.

Alternating pressure pads are well known for the prevention and management of decubitus ulcers in bedridden patients. The formation of decubitus ulcers, commonly known as bedsores, results from, amongst other things, the pressure applied to certain portions of the skin of a bedridden patient. In addition, it is well known that should the lower reflex arc be broken by, for instance, lesion of the spinal cord or of nerve roots then decubitus ulcers of unusual severity and rapidity of onset are likely to develop.

Alternating pressure pads generally comprise two sets of alternately inflatable cells: the duration of the inflation and deflation cycles may last from under two minutes for a gentle massaging effect to over twenty minutes. Huntleigh Technology plc manufacture and supply such an alternating pressure pad system.

A high air pressure in the pads may be needed to support the bony protuberances of a patient and to ensure that the patient is lifted sufficiently away from deflated cells of the pad so that adequate pressure relief is provided. A low air pressure, however, is desirable since it provides a pad which is softer and more comfortable. Optimal pressure support therefore not only varies from patient to patient but also during a given inflation cycle of the pad since the pressure supporting points will change during a cycle. The required optimal support pressure will vary even more as a patient changes from a supine to a sitting position.

It is known to provide a manually adjustable pressure controller to set an optimal pad support pressure. This may be a regulator for the compressor supplying air to the alternating pressure pad. It is also known to provide an automatic pressure controller comprising a convoluted compressible tube placed under the pad. In such a system a small amount of air is diverted through the tube, the passage of air being detected by a pilot valve. When the support pressure in the pad is so inadequate that the pressure exerted by a patient causes the tube to be compressed shut, the pilot valve actuates a throttle which diverts a fixed proportion of air, such as one third, from the compressor to the pad thereby to increase the support pressure. When the tube is not closed, the fixed proportion of air is vented to the air via a relief valve. Such a system, however, is complex, costly and inefficient.

In accordance with the present invention, a pressure controller comprises means sensitive to the fluid pressure and adapted to open a valve when said pressure exceeds a predetermined value, fluid supply means connected at one end to said valve and at the other end being adapted for connection to a pump for inflating the pad, the fluid supply means being arranged, in use, to receive pressure exerted by a patient on said pad and to be compressible in dependence upon the pressure exerted by the patient to reduce the escape of fluid from the valve when the valve is open and thereby to cause a proportion of fluid to continue to inflate the pad. The means sensitive to fluid pressure comprises a fluid tight member inflatable in dependence upon the pressure of the fluid in the pad, and the valve is openable in dependence upon the inflation of the inflatable member above a predetermined pressure.

Such a pressure controller is considerably simpler and cheaper than known devices.

Preferably, the means sensitive to fluid pressure and the valve comprise parts of a pressure relief valve.

Conveniently, the fluid supply means is a compressible tube which allows a proportion of fluid to continue to inflate the pad even when the valve is open, the proportion varying between 0% and 100%, of the fluid from the compressor.

According to another aspect of the invention, an alternating pressure pad system comprises an alternating pressure pad of alternately inflatable sets of cells, a pump connected by a fluid supply line to supply fluid via a rotary valve to the pad, and a pressure controller in accordance with the present invention, the said other end of the fluid supply means of the controller being connected to the fluid supply line. In such a system, the pressure controller allows the excess pressure relief function to be effectively overridden when there is still insufficient support pressure. The system allows for optimal support pressure to be automatically achieved for each set of cells of the pad during the inflation period of that set of cells.

According to a further aspect of the invention, an alternating pressure pad apparatus comprises a pressure controller in accordance with the present invention, an alternating pressure pad of alternately inflatable sets of cells, a pump for supplying fluid to inflate the cells and means to switch between a mode in which the sets of cells are inflated and deflated alternately and a mode in which the sets of cells are inflated simultaneously.

Preferably, the switch means is a rotary valve which comprises a stator having an inlet connected to the fluid supply and two outlets, one connected to each set of cells, a rotor with means to rotate the rotor relative to the stator, and sensing means energisable to stop the rotor in a position such that both sets of cells are connected to the fluid supply line simultaneously.

According to yet another aspect of the present invention, an alternating pressure pad apparatus comprises a pressure controller in accordance with the present invention, an alternating pressure pad of alternately inflatable sets of cells, and a pump for supplying fluid to inflate the cells wherein each set of cells is connected to the pump by a tube the tube connecting one set of cells having a male connector to the pump and the tube connecting the other set of cells having a female connector to the pump thus enabling the tubes to be connected to each other.

According to a further aspect of the present invention, an alternating pressure pad apparatus comprises a pressure controller in accordance with the present invention, an alternating pressure pad of alternately inflatable sets of cells and a sensor pad located beneath the cells, and a pump for supplying fluid to inflate the cells and the sensor pad, wherein each set of cells is connected to the pump by a tube and the sensor pad has an input tube and an output tube connected to the pump, the tubes connecting the cells to the pump having either both male or both female connectors and the tubes connecting the sensor pad to the pump having connectors which will enable connection to the tubes from the cells.

Preferably, the pad has a sensor arranged beneath the pad to detect weight distribution on the pad wherein a relatively soft resilient layer is placed between the pad and sensor and a relatively hard resilient layer is placed beneath the sensor.

Preferred embodiments of the invention will now be described with reference to the accompanying drawings, in which:

FIG. 4 is a cross-sectional view of the cells and sensor pad within an alternating pressure pad system and the connections to the pump;

FIG. 5 shows a variation of the connections to the pump to those in FIG. 4.

Figure 1:
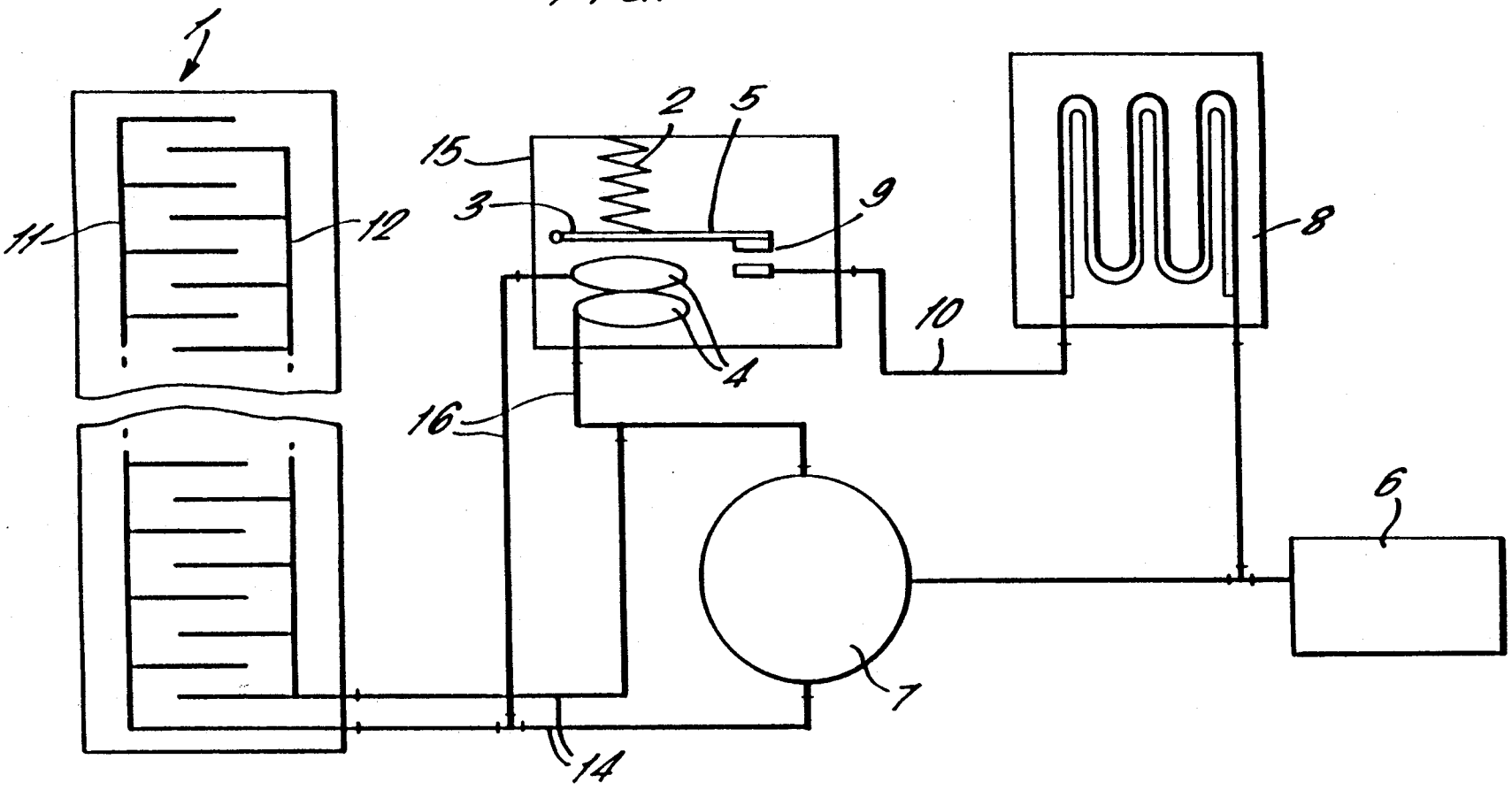
FIG. 1 is a schematic representation of a pressure controller in an alternating pressure pad system, the system further comprising a compressor supplying air to a pad via a rotary valve.

Referring to FIG. 1, an alternating pressure pad 1 is shown comprising a first set 11 and a second set 12 of alternately inflatable cells. Both sets of inflatable cells are supplied with air from a compressor 6 via a rotary valve 7. A pair of air supply lines 14 lead from the rotary valve 7 to the pad, there being provided a further pair of air supply lines 16 leading from the air supply lines 14. Each further air supply line 16 terminates in a fluid tight member 4, sensitive to, and inflatable in dependence upon, the air pressure in the associated set of cells of the pad. Inflation of the members 4 above a predetermined pressure is arranged to cause the opening of a valve having a hinged flap 5 with a seal 9 at one end. The seal 9 closes off one end of a bleed tube 10, being a fluid supply means. The valve is maintained in a closed position by an adjustable spring means 2 when the inflation of the inflatable members 4 is below a predetermined pressure. The inflatable members 4, the valve and the spring 2 comprise parts of a pressure relief valve and are housed within a casing 15.

The bleed tube 10 is connected at one end to the output of the air compressor 6 and at the other end to the valve. The bleed tube 10 comprises a portion which is positioned under the pad to receive pressure exerted by a patient and is compressible in dependence upon this pressure.

The compressible portion of the bleed tube 10 is, in this embodiment, a single compressible tube arranged in a convoluted path and formed as a sensor pad 8. The pad 8 may be approximately 75 cm long and 60 cm wide and formed of two polyurethane sheets welded together to define the single convoluted tube. In an alternative embodiment (not shown), the two sheets may be welded together to define a plurality of interconnected tubes. Tubes approximately 2.2 cm in diameter and spaced 1.9 cm apart have been found to be suitable.

In use, the compressor 6 delivers air to the pad 1 via rotary valve 7 so that each set of cells of the pad is alternately inflated and deflated. The inflation/deflation cycle may repeat over periods varying from two minutes to over twenty minutes. The rotary valve 7 operates so that, during inflation of the set of cells 11, air from the set of cells 12, in addition to air from the compressor 6, passes into the set of cells 11. This is the 'cross-over' point. Further, when, or preferably before, the pressure difference of the air in set of cells 12 over the air from the compressor becomes negligible, the air from the set of cells 12 is prevented from passing into the set of cells 11. Similarly, during inflation of the other set of cells 12, the air from set of cells 11 is allowed to pass into set of cells 12 for an initial period.

The pressure relief valve, indicated generally at 15, is adapted by adjusting the tension of spring means 2 so that when the air pressure in a fully inflated set cf cells exceeds a predetermined pressure, generally below the vascular occulusion pressure of 30 mmHg, hinged flap 5 is opened by the inflation of one of the inflatable members 4. Should the bleed tube 10 of the pad 8 not be compressed when the valve is open then air from compressor 6 will be freely vented to the atmosphere via the bleed tube 10 and the relief valve 15.

Consequently, further inflation of the pad during a given inflation cycle of one set of cells is prevented. Should the support pressure provided by the pad be sufficiently inadequate so that the bleed tube 10 is itself compressed by the weight of the patient, then during a given inflation cycle of a set of cells, the escape of air from the valve will be reduced in dependence upon the degree of compression. Consequently, even with the valve open, a proportion of air from compressor 6 will continue to inflate the set of cells during the inflation cycle for that set of cells. Inflation of the set of cells above the predetermined pressure at which the pressure relief valve opens is thus possible. The amount of air which continues to inflate the set of cells even when the valve is open may vary between 0% and 100% of the air from the compressor and will vary in dependence on the degree of compression of the bleed tube of sensor pad 8. As inflation continues during the inflation cycle the support pressure of the pad will increase so that the compression of the bleed tube 10 decreases as the patient is lifted up. Consequently, passing air into the pad becomes progressively harder as passing air through the fluid supply means becomes progressively easier. Eventually equilibrium and optimal associated support pressure of the pad is reached. This automatic adjustment of the inflation pressure occurs every half cycle, i.e. during the inflation cycle of each set of cells.

Figure 2:
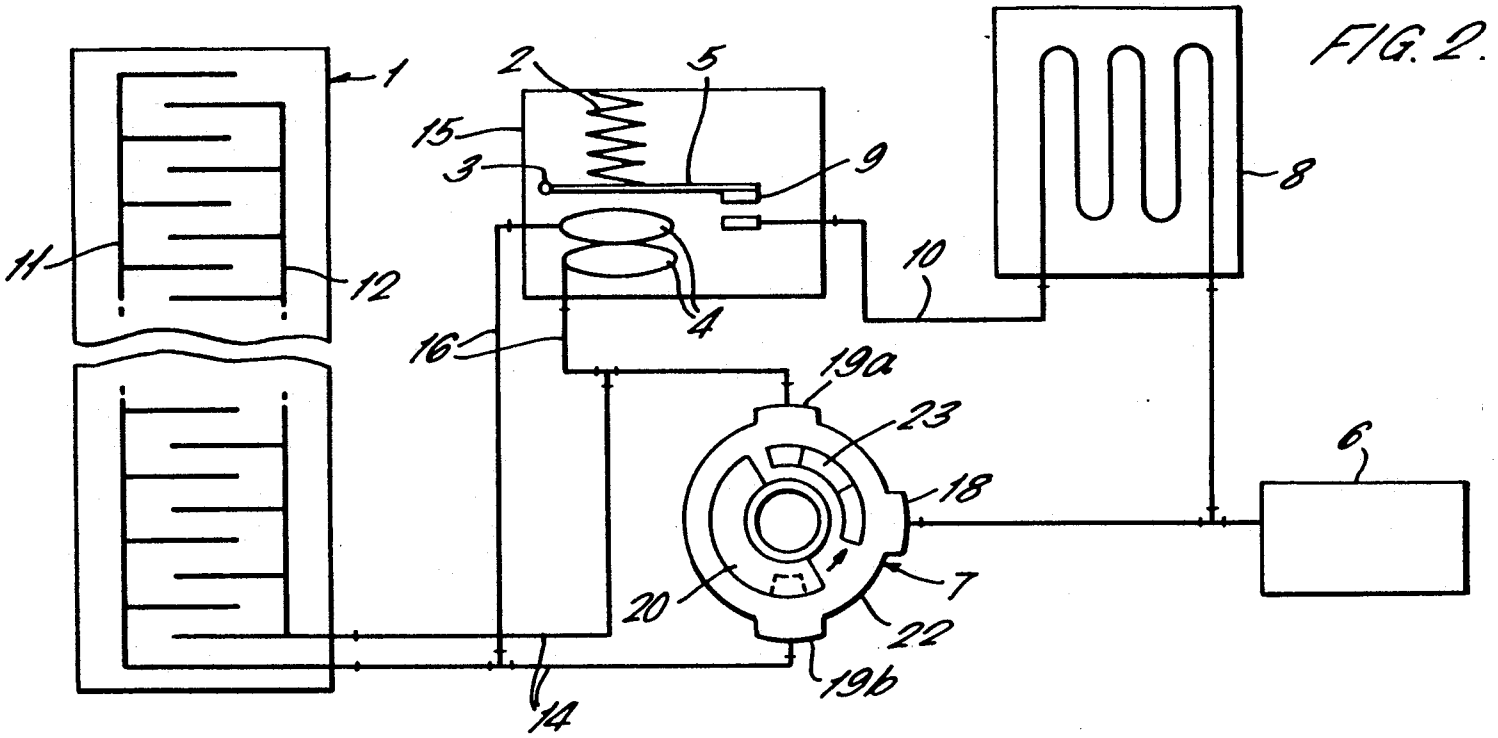
FIG. 2 is a further schematic representation of system with the rotary valve in a dynamic mode.
Figure 3:
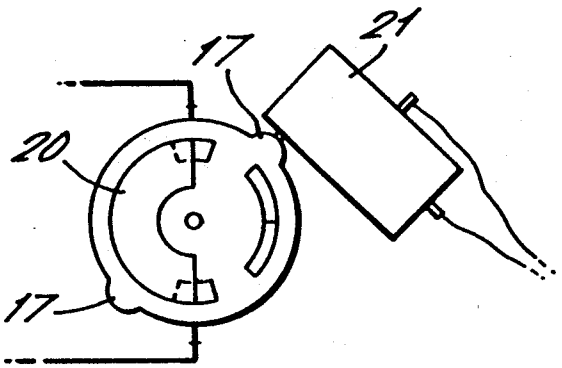
FIG. 3 is a partial view of the rotary valve in FIG. 2 in a static mode with associated switch means.

A further embodiment of the present invention is shown in FIG. 2. In this drawing like reference numerals represent like features as in FIG. 1. FIG. 2 shows an alternating pressure pad and pressure controller having a rotary valve generally indicated at 7 which includes a stator 22, having an inlet 18 and outlets **19*a* and 19*b*, and a rotor 20 which is motor driven. The inlet 18 of the stator 22 is connected to the compressor 6 and the outlets 19*a*, 19*b* are connected to sets of cells 12 and 11 respectively. During one revolution of the rotor 20 within the stator 22 first one set of cells and then the other set is connected to the compressor. However, there is a point in the cycle where both sets of cells 11 and 12 are connected to each other via the rotor 20. FIG. 3 indicates the position of the rotor 20 at which the cells 11 and 12 are connected. This is the cross-over point discussed earlier where during inflation of one set of cells 11, air from the other set of cells 12 is allowed to pass into the cells 11** (or vice versa) for an initial period.

Deflation of the cells 11 and 12 is effected by a vent 23 in the rotor 20 which communicates alternately with outlets **19*a* and 19*b***.

In this embodiment of the present invention it is possible to stop the rotor at the cross-over point so that the air will flow between the cells 11 and 12 until equilibrium is reached and the pressure in the pad becomes static rather than alternating. A static mode is particularly useful if a patient in a delicate condition is placed on the pad since the alternating cycle may be unsuited to his/her condition. For example, patients suffering from severe burns or patients who have undergone major surgery would not be placed on alternating pressure pads. Furthermore, in the care of paraplegics the alternating pressure pad could induce uncontrollable spasms.

The rotor 20 can be driven continuously from a small synchronous motor (not shown). The position of the rotor relative to the stator is controlled by a switch 21 operated by cams 17 which stop the rotor 20 in the correct position relative to the stator 22. The switch 21 could be a microswitch or an optical switch, for example. The switch 21 is arranged to stop the motor which drives the rotor 20 at the cross-over point. The two sets of cells 11 and 12 will then be inflated, to an equal pressure. The pressure within the static pressure pad is then adjusted by the sensor pad 8.

The switch 21 can have one or more positions where the static mode is operative. These positions determine at what pressure the hinged flap is opened by inflation of the inflatable members 4. Generally, if the pressure exceeds a predetermined pressure of 15 or 25 mm Hg, depending on the switch position, the hinged flap 5 is opened. The pressure is usually below the vascular occlusion pressure of 30 mm Hg.

It is preferred if the two sets of cells 11 and 12 can be connected together so that when the pad is disconnected from the compressor 6 the pressure within the pad can be maintained for several hours (see FIGS. 4 and 5). This feature is useful if the patient has to be moved from one location to another without interrupting the treatment process. Furthermore, if the pressure controllers are located at different places within a hospital the ability to disconnect the pad from one supply and reconnect to another supply can be extremely useful. This is achieved by, for example, constructing the fluid supply lines 14 to the sets of of cells and the fluid supply lines to the sensor pad 8 from tubes which can be interconnected. As shown in FIG. 4, the tubes 30 connecting the cells 11 and 12 to the pump are provided with male connectors and the tubes 31 connecting the sensor pad to the pump are provided with female connectors (or vice versa) so that the tubes 30 from the cells can be connected to the tubes 31 from the sensor pad 8.

Such an arrangement is advantageous in that the tubes cannot be connected to the wrong connectors on the pump.

If the arrangement does not include a sensor pad it is preferable if the tube 32 connecting one set of cells 12 to the pump has a male connector and the tube 33 connecting the other set of cells 11 to the pump has a female connector (or vice versa). In this way, the sets of cells 11 and 12 can be interconnected.

The pad should preferably rest upon one or more layers of a suitable material which will allow the pad to be used on hard or soft surfaces without impairment of its operation. A suitable material would be foam rubber.

FIG. 4 shows an arrangement where the sensor pad 8 is placed beneath the pad 1 to monitor the patient's weight distribution. A first soft foam rubber layer 34 would be placed between the pad 1 and the sensor 8 and the sensor 8 would rest upon a layer of hard foam rubber 35. The placement of the sensor 8 upon a hard layer 35 ensures that if the pad 1 rests upon a surface which is not substantially flat the sensor 8 (which is usually in the form of a compressible pad) will not be affected by the irregularities in the surface, for example, by creasing. The soft foam rubber layer 34 between the pad 1 and sensor 8 should be of a thickness which allows the weight distribution of the patient to be transmitted from the pad 1 to the sensor 8.

It is preferable if the pad is enclosed within a water resistant, water vapour permeable cover which is fitted with air vents to remove stagnant air from beneath the patient by the movement of the alternating pressure cells.

It is advantageous if during an electrical power failure the pump is able to retain sufficient pressure within the pad to support the patient for several hours.

What is claimed is:

1. Pressure controller for controlling fluid pressure in an alternating pressure pad, comprising:

means sensitive to fluid pressure and adapted to open a valve when said pressure exceeds a predetermined value;

fluid supply means connected at one end to the valve and at the other end being adapted for connection to a pump for inflating the pad;

and said fluid supply means being arranged, in use, to receive pressure exerted by a patient on the pad and to be compressible in dependence upon the pressure exerted by the patient to reduce the escape of fluid from the valve when the valve is open and thereby to cause a proportion of fluid to continue to inflate the pad.

2. Pressure controller as claimed in claim 1, wherein the means sensitive to fluid pressure and the valve comprise part of a pressure relief valve.

3. Pressure controller as claimed in claim 2, wherein the means sensitive to fluid pressure comprises a fluid tight member inflatable in dependence upon the fluid pressure, and the valve is openable in dependence upon the inflation of the member above a predetermined pressure.

4. Pressure controller as claimed in claim 3, wherein the valve is maintained in a closed position by an adjustable spring means when the inflation of the member is below said predetermined pressure.

5. Pressure controller as claimed in claims 1, 2, 3 or 4, wherein the fluid supply means comprises a plurality of compressible tubes positioned under a portion of the alternating pressure pad.

6. Pressure controller as claimed in claims 1, 2, 3 or 4, wherein the fluid supply means comprises a single compressible tube arranged in a convoluted path under a portion of the alternating pressure pad.

7. Pressure controller as claimed in claims 1, 2, 3 or 4, wherein the pad comprises a plurality of inflatable cells and wherein the fluid supply means comprises at least one compressible tube arranged under a portion of the pad and substantially at right angles to the inflatable cells of the pad.

8. Pressure controller as claimed in claims 1, 2, 3 or 4, wherein the fluid supply means is compressible to allow a proportion of fluid to continue to inflate the pad when the valve is open, the proportion varying between 0% and 100% of the fluid from the compressor.

9. Alternating pressure pad apparatus comprising an alternating pressure pad of alternately inflatable sets of cells and a sensor pad located beneath the cells, a pump for supplying fluid to inflate the cells and the sensor pad, wherein each set of cells is connected to the pump by a tube and the sensor pad has an input tube and an output tube connected to the pump, the tubes connecting the cells to the pump having either both male or both female connectors and the tubes connecting the sensor pad to the pump having connectors which will enable connection to the tubes from the cells.

* * * * *